US009045935B2

(12) United States Patent
McDonald

(10) Patent No.: US 9,045,935 B2
(45) Date of Patent: Jun. 2, 2015

(54) VERTICALLY FOLDING WALL PARTITION

(71) Applicant: RAILQUIP ENTERPRISES INC., Baie d'Urfe (CA)

(72) Inventor: Mark McDonald, Beaconsfield (CA)

( * ) Notice: Subject to any disclaimer, the term of this patent is extended or adjusted under 35 U.S.C. 154(b) by 175 days.

(21) Appl. No.: 13/632,538

(22) Filed: Oct. 1, 2012

(65) Prior Publication Data

US 2014/0090788 A1 Apr. 3, 2014

(51) Int. Cl.

| | |
|---|---|
| ***E05F 15/00*** | (2006.01) |
| ***E06B 3/48*** | (2006.01) |
| ***E05D 15/26*** | (2006.01) |

(52) U.S. Cl.

CPC ..... *E06B 3/483* (2013.01); *E05D 15/262* (2013.01)

(58) Field of Classification Search

CPC ..... E05D 15/262; E06B 3/94; B63B 19/203
USPC ..... 160/188, 193, 207, 218, 40, 84.08, 113
See application file for complete search history.

(56) References Cited

U.S. PATENT DOCUMENTS

| | | | | | |
|---|---|---|---|---|---|
| 173,309 | A | * | 2/1876 | Lipsey | 254/399 |
| 681,135 | A | * | 8/1901 | Petree | 254/399 |
| 2,027,992 | A | | 1/1936 | Maurer | |
| 2,780,197 | A | * | 2/1957 | Von Tell | 114/202 |
| 2,990,556 | A | * | 7/1961 | Bender | 4/500 |
| 3,108,631 | A | * | 10/1963 | Dahlin | 160/193 |
| 3,199,576 | A | * | 8/1965 | Jericijo | 160/193 |
| 3,979,861 | A | * | 9/1976 | Fromme et al. | 52/71 |
| 4,199,018 | A | * | 4/1980 | Hirschel et al. | 160/84.08 |
| 4,303,117 | A | | 12/1981 | Lindbergh | |
| 4,867,221 | A | * | 9/1989 | Dixon et al. | 160/84.08 |
| 5,062,464 | A | | 11/1991 | Peterson | |
| 6,267,169 | B1 | | 7/2001 | McDonald | |
| 6,808,000 | B1 | | 10/2004 | Peterson | |
| 7,156,142 | B2 | | 1/2007 | Peterson | |
| 8,327,905 | B2 | | 12/2012 | McDonald et al. | |

FOREIGN PATENT DOCUMENTS

| | | |
|---|---|---|
| AU | 653284 | 9/1994 |
| AU | 2004201914 | 11/2004 |
| CA | 2064348 | 9/1992 |
| CA | 2465433 | 11/2004 |
| CA | 2597703 | 11/2004 |
| DE | 69222416 | 4/1998 |
| EP | 0587572 | 9/1997 |
| EP | 1475508 | 11/2004 |
| JP | 4336614 | 9/2009 |

* cited by examiner

*Primary Examiner* — Katherine Mitchell
*Assistant Examiner* — Abe Massad
(74) *Attorney, Agent, or Firm* — Norton Rose Fulbright Canada LLP

(57) ABSTRACT

A vertically folding wall partition with a set of foldable panel assemblies serially and pivotally connected through a series of vertically spaced apart supports, and a moving mechanism varying a distance between opposed ends of each panel assembly following a downwardly progressing sequence starting with the uppermost panel assembly as the panel assemblies are moved from the deployed position to the folded position, and the moving mechanism varying the distance between the opposed ends of each panel assembly following an upwardly progressing sequence starting with the lowermost of the panel assemblies as the panel assemblies are moved from the folded position to the deployed position.

18 Claims, 8 Drawing Sheets

VERTICALLY FOLDING WALL PARTITION

TECHNICAL FIELD

The present invention relates to operable wall partitions and, more particularly, to such operable wall partitions which are vertically movable between raised and lowered positions.

BACKGROUND OF THE ART

It is well known to use movable wall partitions to selectively divide interior building spaces, such as conference rooms, halls and school gymnasiums, into smaller interior spaces.

Vertically folding wall partitions are known, but such partitions usually fold in such a manner that may cause the folding bottom panels to interfere with objects placed near the wall partition and/or present a risk of injury to a person located in proximity of the wall partition as the panels move outwardly away of the plane of the wall towards the collapsed, folded position thereof.

SUMMARY

In one aspect, there is provided a vertically folding wall partition comprising: a set of foldable panel assemblies serially and pivotally connected through a series of vertically spaced apart supports, an uppermost of the panel assemblies having a top end pivotally connected to a hanger for engagement to an overhead structure and a lowermost of the panel assemblies having a bottom end pivotally connected to a bottom linkage, each panel assembly including an upper panel and a lower panel pivotally connected to one another, the upper and lower panels extending substantially in a common vertical plane when in a deployed position and extending laterally outwardly of said common vertical plane in an opposed surface-to-surface stacked relationship when in a folded position; and a moving mechanism engaging each support and the bottom linkage to sequentially move the panel assemblies between the folded and deployed positions, the moving mechanism varying a distance between opposed ends of each panel assembly following a downwardly progressing sequence starting with the uppermost panel assembly as the panel assemblies are moved from the deployed position to the folded position, and the moving mechanism varying the distance between the opposed ends of each panel assembly following an upwardly progressing sequence starting with the lowermost of the panel assemblies as the panel assemblies are moved from the folded position to the deployed position.

In another aspect, there is provided a vertically folding wall partition comprising: first and second sets of foldable panel assemblies interconnected by a series of vertically spaced apart supports to define a double wall partition, the panel assemblies of each set being serially and pivotally connected through the supports, each panel assembly including an upper panel and a lower panel pivotally connected to one another, the upper and lower panels of a same one of the sets extending substantially in a common vertical plane when in a deployed position and extending laterally outwardly of said common vertical plane in an opposed surface-to-surface stacked relationship when in a folded position, the panel assemblies of the first and second sets extending laterally outwardly away from each other in the deployed position; a hanger pivotally connected to a top end of an uppermost of the panel assemblies of each set for engagement to an overhead structure; a bottom linkage pivotally connected to a bottom end of a lowermost of the panel assemblies of each set; a support pulley retained on each support and a plurality of hanger pulleys retained on the hanger, each pulley being rotatable about a respective horizontal axis; a cable having a first end connected to the bottom linkage and extending directly to engagement with one of the hanger pulleys, following which the cable extends in engagement with each support pulley in alternation with a corresponding one of the hanger pulleys and ending with one of the hanger pulleys, the support pulleys being engaged following an upwardly progressing sequence starting at a lowermost of the support pulleys; and a motor operatively connected to a second end of the cable to selectively apply tension thereto and release tension therefrom.

In a further aspect, there is provided a method of lifting a wall partition including a series of pivotally connected vertically foldable panel assemblies from a deployed position where two pivotally connected panels thereof extend substantially in a common vertical plane, the method comprising: lifting a lowermost of panel assemblies in the deployed position by sequentially moving each remaining panel assembly from the deployed position to a folded position where the panels thereof extend laterally outwardly of said common vertical plane in an opposed surface-to-surface stacked relationship, the remaining panel assemblies being moved to the folded position following a downwardly progressing sequence starting with an uppermost of the panel assemblies; and moving the lowermost panel assembly to the folded position where the panels thereof extend laterally outwardly of said common vertical plane in an opposed surface-to-surface stacked relationship.

DESCRIPTION OF THE DRAWINGS

Reference is now made to the accompanying figures in which.

DETAILED DESCRIPTION

Figure 1:
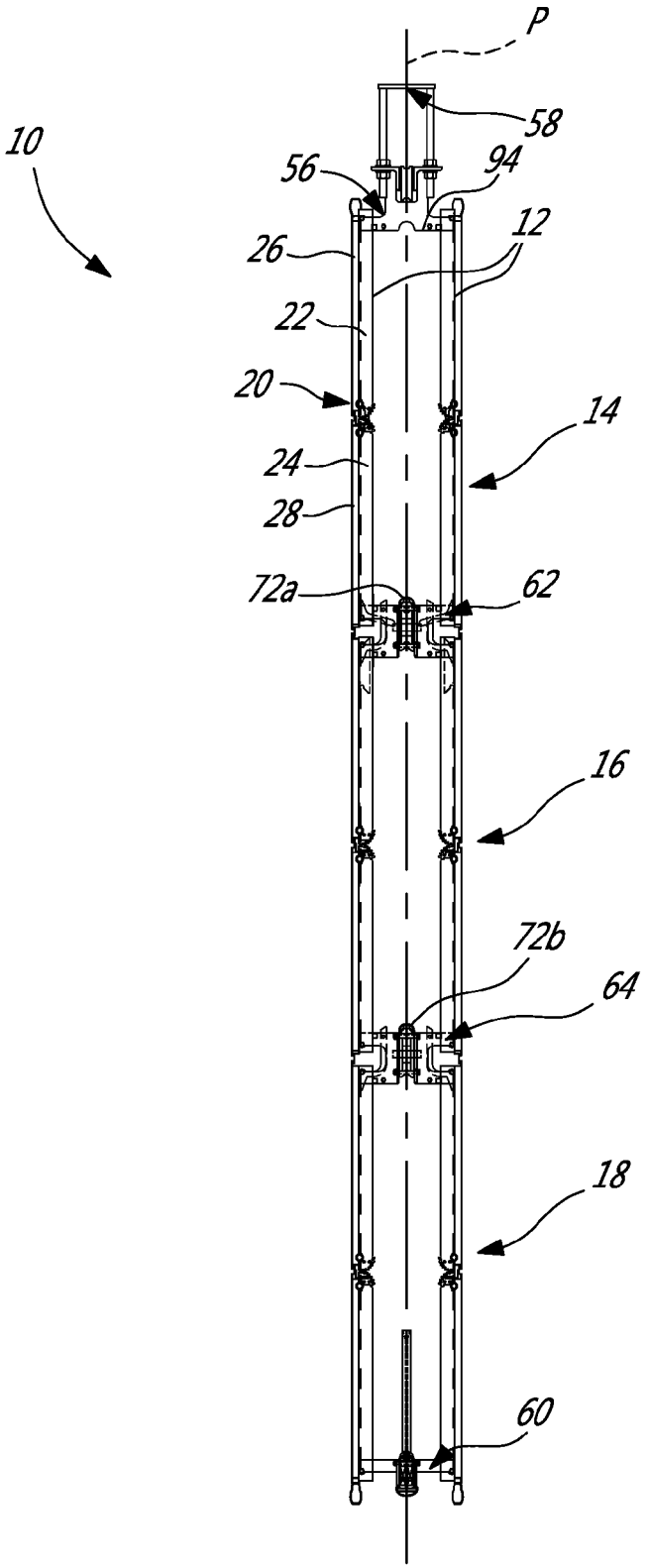
FIG. 1 is a schematic cross-sectional view of a folding wall partition in accordance with a particular embodiment, shown in a deployed position.

Now referring to the drawings and in particular to FIG. 1, a vertically folding wall partition 10 is generally shown. The vertically folding wall partition 10 is adapted to be mounted to an overhead structure of a building, such as a ceiling structure, for movements between a completely folded position in which the vertically folding wall partition 10 is retracted and raised and may be stored in the ceiling structure, and a deployed position in which the vertically folding wall partition 10 is unfolded, straight and extends vertically downwardly from the ceiling structure to a support surface, such as a floor, in order to divide an interior building space into two smaller spaces. In a particular embodiment, the overall dimensions of the vertically folding wall partition 10 are such that when it is displaced to its deployed position, the wall partition 10 forms a unitary flat wall which extends completely across the area to be divided.

The vertically folding wall partition 10 generally comprises at least one set 12 of pivotally connected panel assemblies, serially disposed along the vertical direction. In the embodiment shown, two sets 12 of pivotally connected panel assemblies are provided, symmetrically disposed relative to the central plane P of the vertically folding wall partition 10 to form a double sided wall partition, with each set including an uppermost panel assembly 14, an intermediate panel assembly 16, and a lowermost panel assembly 18. In alternate embodiments, more than one intermediate panel assembly per set may be provided. The horizontal dimension of the wall partition 10 may be defined by a plurality of sets 12 of panel assemblies interconnected side by side with the sets 12 being activated to fold and deploy simultaneously.

Each panel assembly 14, 16, 18 includes at least one and preferably two horizontally spaced apart vertically foldable arms 20. Each foldable arm includes an upper arm segment 22 and a lower arm segment 24 which are pivotally interconnected such as to fold outwardly away from the central plane P of the wall partition 10, and away from the other set 12 of panel assemblies in the case of the double-sided wall partition shown. Each panel assembly 14, 16, 18 also includes an upper panel 26 supported by the upper arm segment(s) 22 and a lower panel 28 supported by the lower arm segment(s) 24. The upper and lower panels 26, 28 are preferably of a rectangular construction and elongated in the horizontal direction. The pivotal connection between the arm segments 22, 24 of each panel assembly 14, 16, 18 and between the adjacent panel assemblies 14, 16, 18 define parallel pivot axes which extend in the horizontal direction when the wall partition 10 is attached to the overhead structure.

Figure 2:
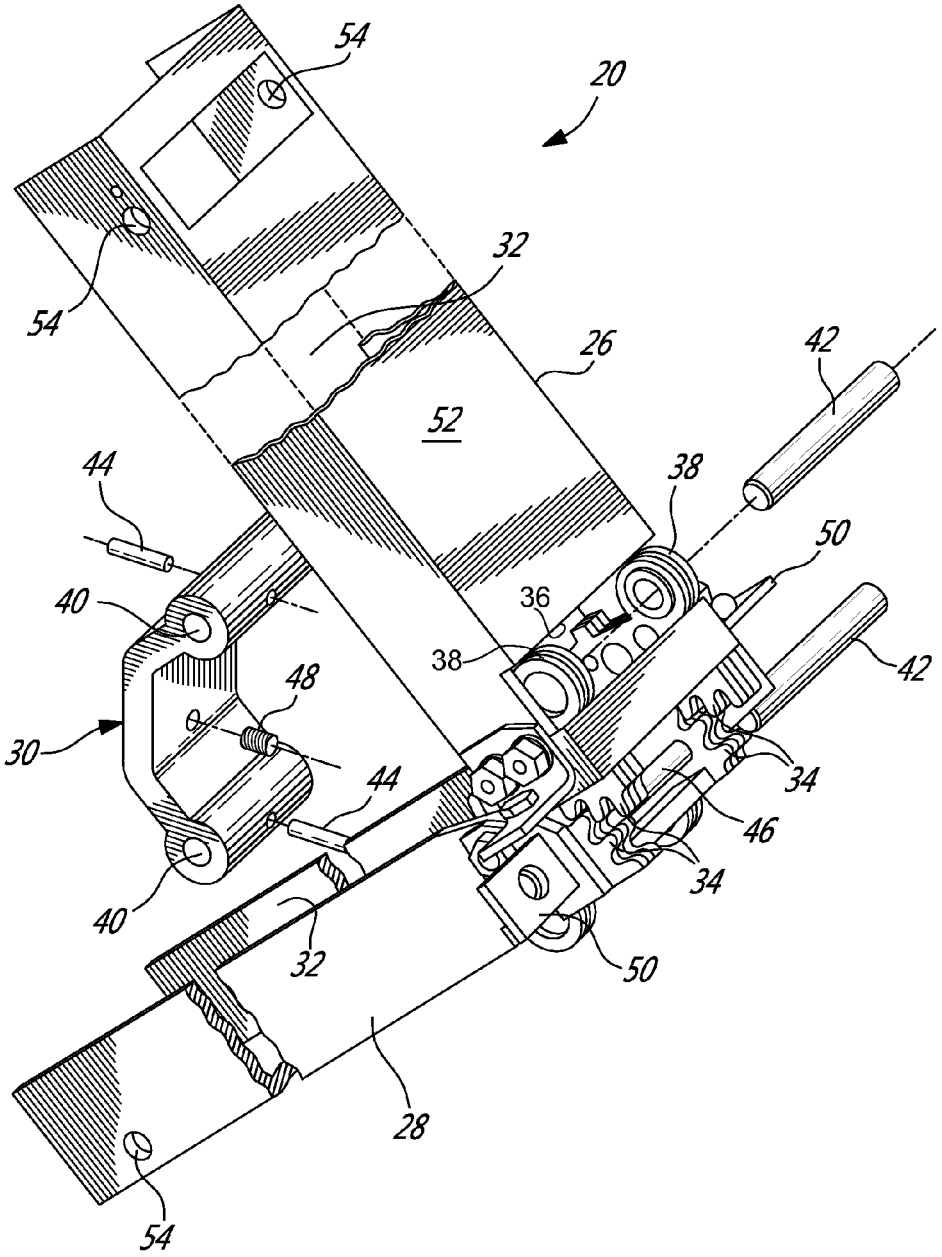
FIG. 2 is a tridimensional view, partly exploded, of a connection between adjacent segments of the wall partition of FIG. 1.

Referring now to FIG. 2, an exemplary pivotal connection between the upper and lower arm segment 22, 24 of each vertically foldable arm 20 is shown; it is understood that other appropriate types of pivotal connections allowing the arm 20 to fold outward away from the plane P of the wall partition 10 may be provided. In the embodiment shown, the upper and lower arm segments 22, 24 of each vertically foldable arm are pivotally interconnected at adjacent ends by a C-shaped link 30. The arm segments 22, 24 each have a C-shaped cross-section and each define an internal channel 32 which is open towards the central plane of the wall partition 10 to receive therein the C-shaped link. Two pairs of cooperating spur gears 34 are secured within the respective internal channels 32 of the arm segments 22, 24 at adjacent or confronting ends thereof to ensure that the arm segments 22, 24 move outwardly and inwardly at the same rate during contraction and expansion of the wall partition 10. A rectangular cut-out portion 36 is defined in the adjacent ends of the arm segments 22, 24 and a pair of spaced-apart bushings 38 extends outwardly of each cut-out portion 36.

The C-shaped link 30 defines at opposed ends thereof two cylindrical passages 40 which are respectively adapted to be positioned in alignment with the corresponding pairs of bushings 38 for receiving respective hinge pins 42 therethrough in order to pivotally secure the arm segments 22, 24 to the C-shaped link 30 at two distinct pivot points. A spring tension pin 44 is inserted transversally through each cylindrical passage 40 to prevent axial removal of the associated hinge pin 42. A bumper pin 46 extends transversally between the spur gears 34 of the arm segments 22, 24. A set screw 48 is threadingly engaged with the C-shaped link 30 to cooperate with the bumper pin 46 to limit inward movements of the confronting ends of the arm segments 22, 24 when the wall partition 10 is displaced to its deployed position.

Angled panel supports 50 are mounted on the opposed outer sides of the arm segments 22, 24 at the confronting ends thereof to secure the panels 26, 28 to respective mounting walls 52 of the arm segments 22, 24. Accordingly, the upper panel 26 is secured to the upper arm segment 22 while the lower panel 28 is secured to the lower arm segment 24. In the embodiment shown, the width of each panel 26, 28, in the vertical direction, correspond to the length of the associated arm segment 22, 24 to ensure that the wall partition 10 will have a solid, planar, unbroken appearance when the arm segments 22, 24 are vertically oriented.

The ends of the arm segments 22, 24 opposed the confronting ends also include a transversal passage 54 defined therein for receiving a hinge pin for connection to the adjacent arm or structure as will be further detailed below.

Referring back to FIG. 1, the upper arm segment 22 of the uppermost panel assembly 14 of each set 12 is pivotally mounted at its upper end, through the corresponding transversal passage 54 (FIG. 2), to a hanger 56 fixed to the ceiling structure through a support plate 58. The lower arm segment 24 of the lowermost panel assembly 18 of each set 12 is pivotally mounted at its lower end, through the corresponding transversal passage 54 (FIG. 2), to a bottom linkage 60. The lower arm segment 24 of the uppermost panel assembly 14 and the upper arm segment 22 of the intermediate panel assembly 16 of each set 12 are pivotally connected to each other through pivotal connections with an upper support 62. Similarly, the lower arm segment 24 of the intermediate panel assembly 16 and the upper arm segment 22 of the lowermost panel assembly 18 of each set 12 are pivotally connected to each other through pivotal connections with a lower support 64.

In a double-sided wall partition such as that of the embodiment shown, the uppermost panel assemblies 14 of the two sets 12 are connected to the same hanger 56, the uppermost and intermediate panel assemblies 14, 16 of the two sets 12 are interconnected through the same upper support 62, the intermediate and lowermost panel assemblies 16, 18 of the two sets 12 are interconnected through the same lower support 64, and the lowermost panel assemblies 18 of the two sets 12 are connected to the same bottom linkage 60.

Figure 3:
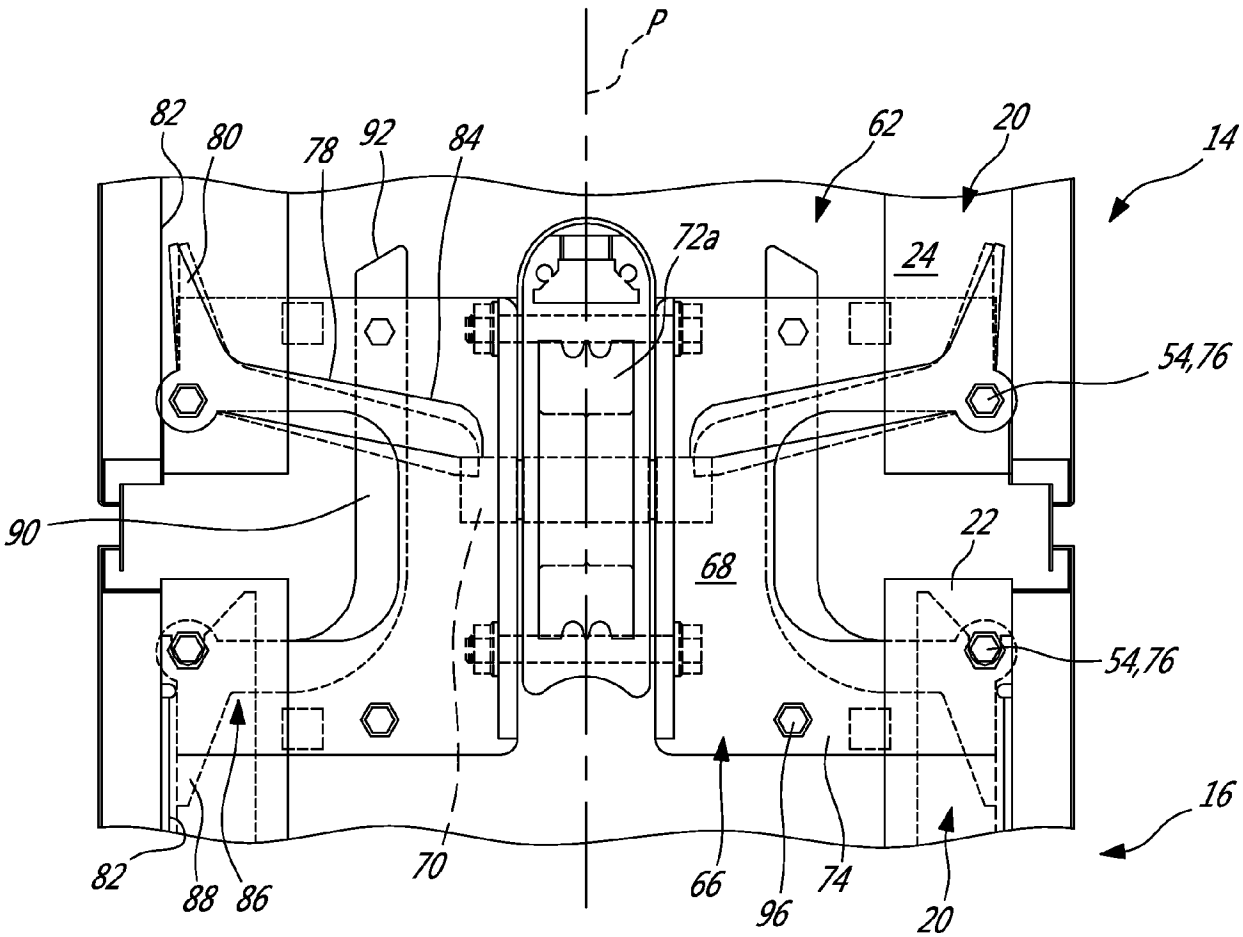
FIG. 3 is a schematic cross-sectional view of a support of the wall partition of FIG. 1.

Referring to FIG. 3, the upper support 62 according to a particular embodiment is shown; it is understood that other appropriate types of supports may be provided. The upper support 62 is symmetrical relative to the central plane P of the wall partition 10, and ensures that that the foldable arms 20 of the uppermost panel assemblies 14 disposed on opposed side of the central plane P fold and unfold conjointly, and that the foldable arms 20 of the intermediate panel assemblies 16 disposed on opposed sides of the central plane P fold and unfold conjointly.

The upper support 62 includes two links 66 each having a generally C-shaped configuration, with central portions 68 thereof being fixedly mounted on opposed sides of a sheave pin 70 receiving a pulley 72*a* rotatable between the links 66. Each link 66 has two legs 74 extending from the central portion 68 away from the central plane P, and each leg 74 has a transversal passage defined therein adapted to receive an associated hinge pin 76 engaged in the transversal passage 54 of the respective foldable arm 20. Retaining pins and retaining rings may be provided for preventing axial disengagement of the hinge pins 76.

The upper support 62 includes top and bottom pairs of kicker levers. The top levers 78 are substantially L-shaped, and are each pivotally connected on the lower arm segment 24 of the foldable arm 20 of the respective uppermost panel assembly 14, for example by the corresponding hinge pin 76.

Each top lever 78 has a smaller upper leg 80 extending upwardly from the pivot point and close to an inner surface 82 of the respective lower arm segment 24, and a longer inner leg 84 extending inwardly from the pivot point to a location adjacent a trigger element, which in the embodiment shown is the sheave pin 70. The inner leg 84 is located upwardly of the sheave pin 70; the top levers 78 are shown in dotted lines in a rest position, where the sheave pin (not shown for this position) is located below. Each top lever 78 is sized such that when the sheave pin 70 starts to move upwardly, it contacts and pushes the inner leg 84 of the top levers 78 upwardly and pivots the top levers 78 toward their engaged position, where each upper leg 80 pushes outwardly against the inner surface 82 of the corresponding lower arm segment 24, thus pushing the foldable arm 20 of the respective uppermost panel assembly 14 towards its folded position.

The bottom levers 86 are substantially Z-shaped, each being pivotally connected on the upper arm segment 22 of the foldable arm 20 of the respective intermediate panel assembly 16, for example by the corresponding hinge pin 76. Each bottom lever 86 has a smaller lower leg 88 extending downwardly from the pivot point and close to an inner surface 82 of the respective upper arm segment 22, and a longer L-shaped upper leg 90 extending inwardly then upwardly from the pivot point. The upper leg 90 has an angled end 92. Each bottom lever 86 is sized such that when the upper support 62 comes close to or in contact with the hanger 56, the angled end 92 of the upper leg 90 engages a trigger element located on the hanger 56. In the embodiment shown in FIG. 1, the trigger element is a pin 94 extending from the hanger 56, and the angled end 92 slides on the pin 94. The upper leg 90 is pushed inwardly and pivots the bottom lever 86 toward its engaged position, where each lower leg 88 pushes outwardly against the corresponding upper arm segment 22, thus pushing the foldable arm 20 of the respective intermediate panel assembly 16 towards its folded position.

The lower support 64 is similar to the upper support 62, but with the top pair of levers being omitted, and the bottom pair of levers 86 being pivotally engaged to the upper arm segments 22 of the lowermost panel assemblies 18. The upper support 62 includes two trigger elements, shown in FIG. 3 as pins 96, which engage the bottom levers 86 of the lower support 64 when the two supports 62, 64 come close or in contact with each other. The angled end 92 of the upper leg 90 of each bottom lever 86 of the lower support 64 slides on the pin 96 extending from the upper support 62, pushing the upper leg 90 inwardly and pivoting the bottom lever 86 toward its engaged position, where each lower leg 88 pushes outwardly against the corresponding upper arm segment 22, thus pushing the foldable arm 20 of the respective lowermost panel assembly 18 towards its folded position.

It is understood that for each set 12 of panel assemblies, the pivot points of the hanger 56 and of the links 66 are in vertical alignment at a predetermined distance from the central plane P of the wall partition 10, and accordingly move vertically in a same plane during operation of the wall partition 10.

Figure 4A:
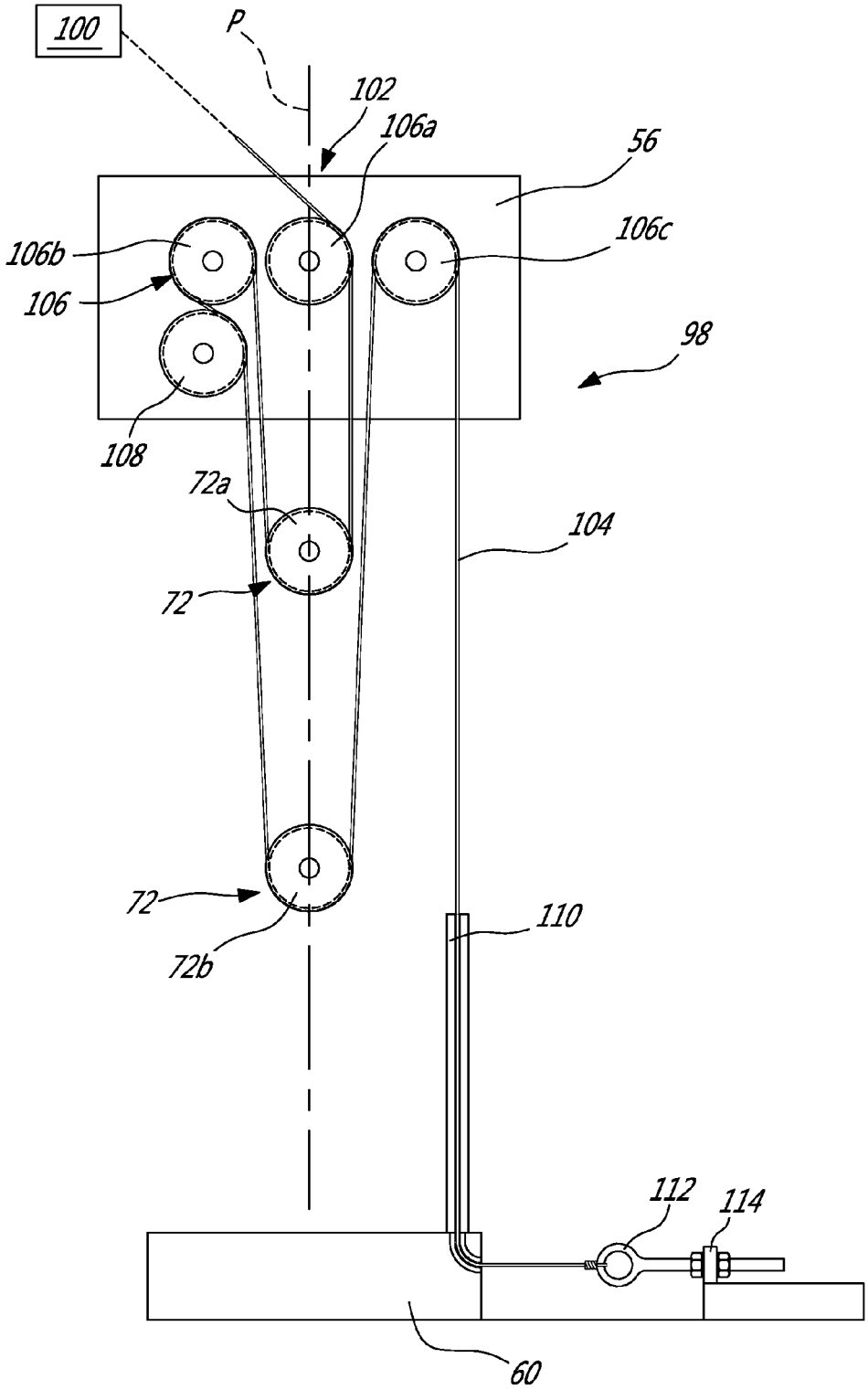
FIG. 4A is a schematic view of a cable and pulley assembly of the wall partition of FIG. 1 in accordance with a particular embodiment.
Figure 4B:
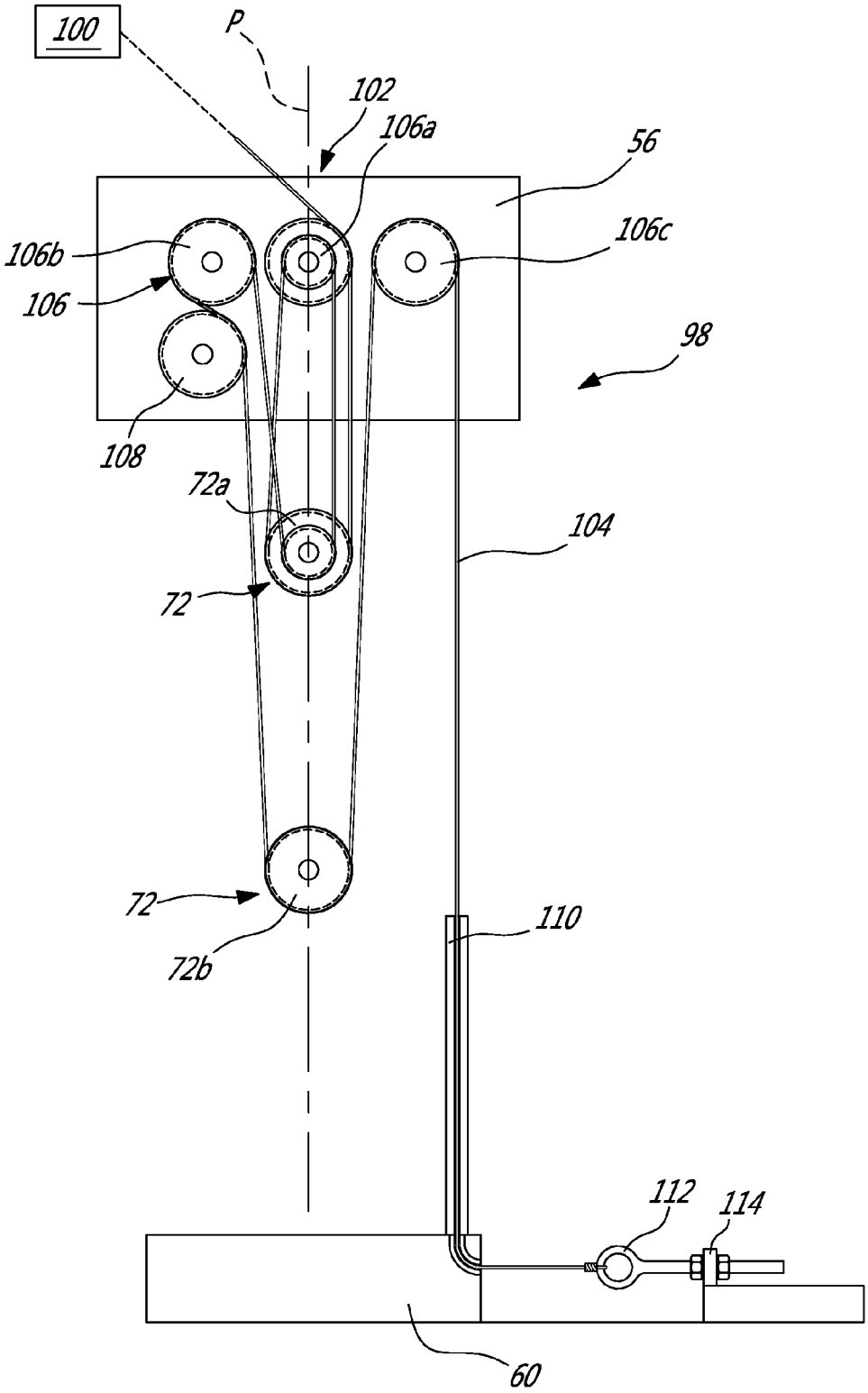
FIG. 4B is a schematic view of a cable and pulley assembly of the wall partition of FIG. 1 in accordance with another particular embodiment.

Referring to FIGS. 4A-4B, the vertically folding wall partition 10 further includes a moving mechanism 98 which is adapted to cause the wall partition 10 to fold in a sequence starting with the uppermost panel assemblies 14, followed by the intermediate panel assemblies 16 and then by the lowermost panel assemblies 18. The moving mechanism 98 comprises a motor 100, and a cable and pulley assembly 102 which includes a cable 104 operatively connected to the motor 100 which selectively applies tension thereto and releases tension therefrom and a plurality of pulleys engaged to the cable 104. In an embodiment where the horizontal dimension of the double-sided wall partition 10 is defined by a plurality of sets 12 of panel assemblies interconnected side by side, a cable and pulley assembly 102 may be provided for each pair of symmetrically disposed sets 12 of panel assemblies sharing the same supports 62, 64, and a common motor 100 may simultaneously activate all the cable and pulley assemblies 102.

The plurality of pulleys includes a support pulley 72*a,b* rotationally retained on each of the supports 62, 64, and a plurality of hanger pulleys 106*a,b,c* rotationally retained on the hanger 56. In the embodiment shown where each set 12 of panel assemblies includes three panel assemblies 14, 16, 18, two support pulleys 72*a,b* and three hanger pulleys 106*a,b,c* are provided, with the first hanger pulley 106*a* being located in between the second and third hanger pulleys 106*b,c*. A stabilizing pulley 108 is also mounted to the hanger 56 below and adjacent the second hanger pulley 106*b*. The number of hanger pulleys 106*a,b,c* will vary with the number of panel assemblies provided in each set 12. Each pulley 72*a,b*, 106*a,b,c* is mounted for rotation about a horizontal axis. The support pulleys 72*a,b* are centered relative to the central plane P of the wall partition 10.

In one particular embodiment illustrated in FIG. 4A, the cable 104 extends from the motor 100 around the first hanger pulley 106*a*, then downwardly to the support pulley 72*a* of the upper support 62. The cable 104 then extends around the upper support pulley 72*a* and upwardly to and around the second hanger pulley 106*b*, then downwardly between the second hanger pulley 106*b* and the stabilizing pulley 108, to the support pulley 72*b* of the lower support 64. The cable 104 then extends around the lower support pulley 72*b* and upwardly to and around the third hanger pulley 106*c*. The cable 104 extends from the third hanger pulley 106*c* down to the bottom linkage 60 where it is fixed. The bottom portion of the cable 104 extends through a hollow stabilizer rod 110 extending vertically upwardly from one end of the bottom linkage 60. The end of the cable 104 is attached to a ring-shaped head 112 of a horizontal threaded rod threadingly engaged with a securing member 114 fixed to the bottom linkage 60. The lowermost panel assembly 18 may include an added weight (ballast) to assist in the obtention of the desired folding sequence described further below.

In another particular embodiment illustrated in FIG. 4B, the cable 104 follows a similar path, except that it extends around the support pulley 72*a*, back to the first hanger pulley 106*a*, and back down to the support pulley 72*a* before extending to the second hanger pulley 106*b*. The support pulley 72*a* and the first hanger pulley 106*a* are double sheave pulleys to receive the cable 104. This configuration minimizes the tension required to lift the upper support 62.

In the embodiments shown as well as in other embodiments where each set 12 of panel assemblies has more than one intermediate panel assembly 16, the cable 104 extends from the bottom linkage 60 directly to engagement with one of the hanger pulleys 106, following which the cable extends in engagement with each support pulley 72 in alternation with one of the hanger pulleys 106 and ending with one of the hanger pulleys 106 before reaching the motor, with the support pulleys 72 being engaged following an upwardly progressing sequence starting at a lowermost of the support pulleys 72.

Figure 5A:
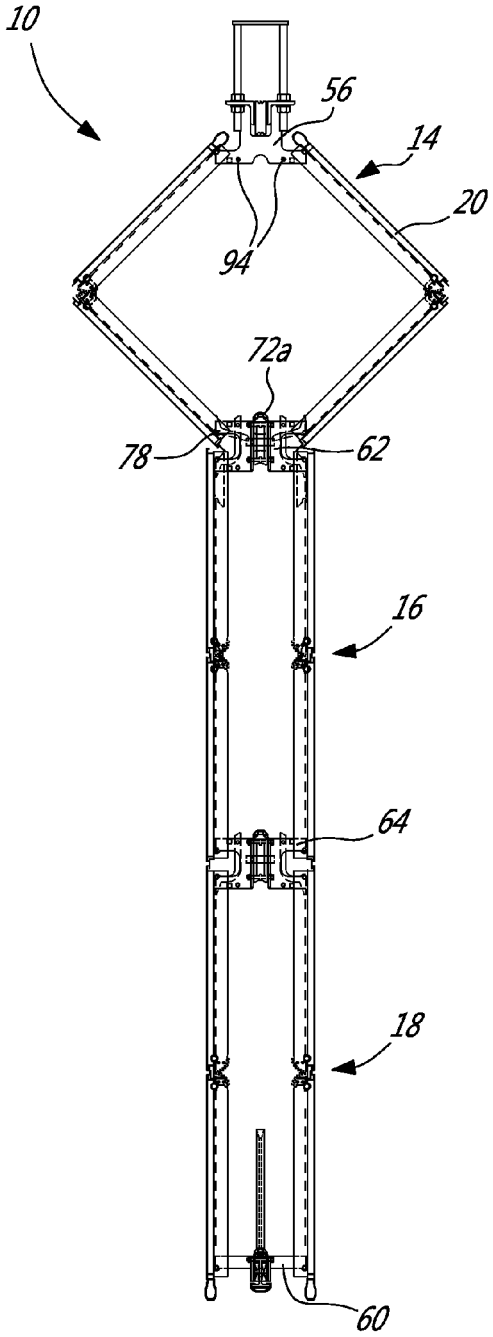
FIGS. 5A-5F are schematic cross-sectional view of the wall partition of FIG. 1 showing the folding sequence thereof.

Referring now to FIGS. 5A to 5F, the sequential folding and unfolding operations of the wall partition 10 will be described. When it is desired to move the wall partition 10 from the deployed position in which the vertically folding wall partition 10 is unfolded, straight and extends vertically downwardly from the ceiling structure to a support surface (FIG. 1) to the retracted position in which the wall partition is raised and may be stored in the ceiling structure (FIG. 5F), the motor 100 is activated so that the cable(s) 104 are simultaneously and equally drawn. As seen in FIG. 5*a*, the pulley 72*a* of the upper support 62 is displaced upwardly first, since the tension in the cable 104 required to lift the upper support 62 is smaller than the tension required to reduce the distance between the two supports 62, 64 or between the lower support 64 and the bottom linkage 60, due to the configuration of the cable and pulley assembly 102 and/or the relative weights of the panel assemblies 16, 18. The upward movement of the sheave pin 70 of the upper support 62 engages the top levers 78 of the upper support 62, which assist in the folding motion of the foldable arms 20 of the uppermost panel assemblies 14 and provide for a soft start of their folding motion. The supports 62, 64 and bottom linkage 60 move upwardly while maintaining the distance between the two supports 62, 64 and between the lower support 64 and the bottom linkage 60 constant, thus maintaining the intermediate and lowermost panel assemblies 16, 18 in their deployed positions as the uppermost panel assemblies 14 are folding.

Figure 5B:
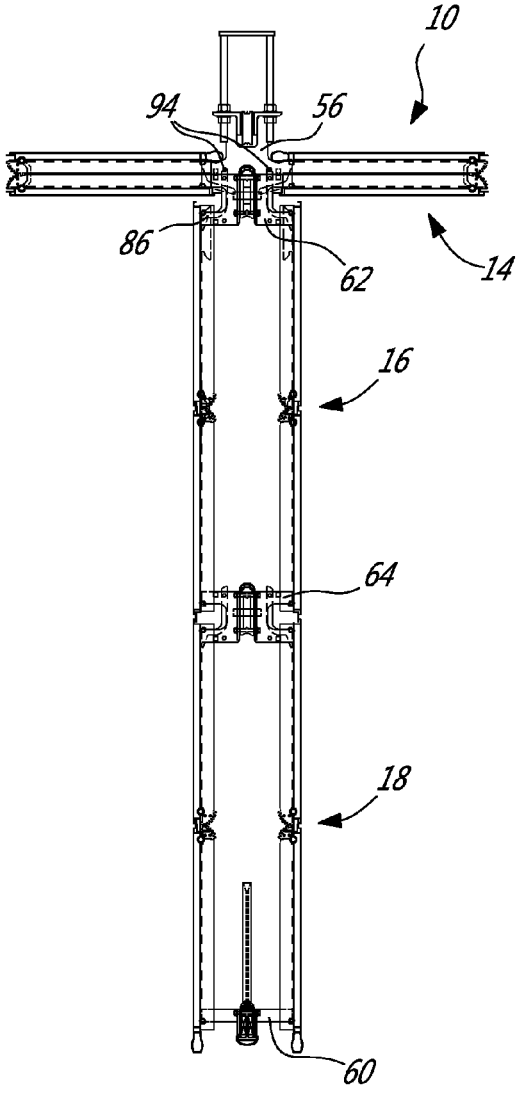
Figure 5C:
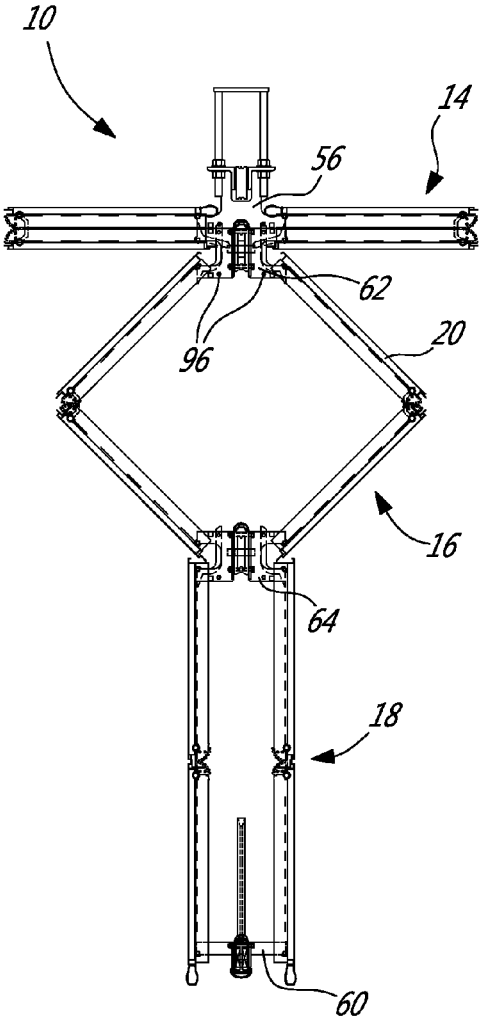

Once the upper support 62 has been displaced up to the hanger 56 so as to completely collapse the uppermost panel assemblies 14 in a surface-to-surface stacked relationship, as shown in FIG. 5B, the pins 94 of the hanger 56 engage the bottom levers 86 of the upper support 62, which assist in the folding motion of the foldable arms 20 of the intermediate panel assemblies 16 and provide for a soft start of their folding motion. The lower support 64 and bottom linkage 60 move upwardly while maintaining the distance therebetween constant, thus maintaining the lowermost panel assemblies 18 in their deployed positions as the intermediate panel assemblies 16 are folding, as shown in FIG. 5C.

Figure 5D:
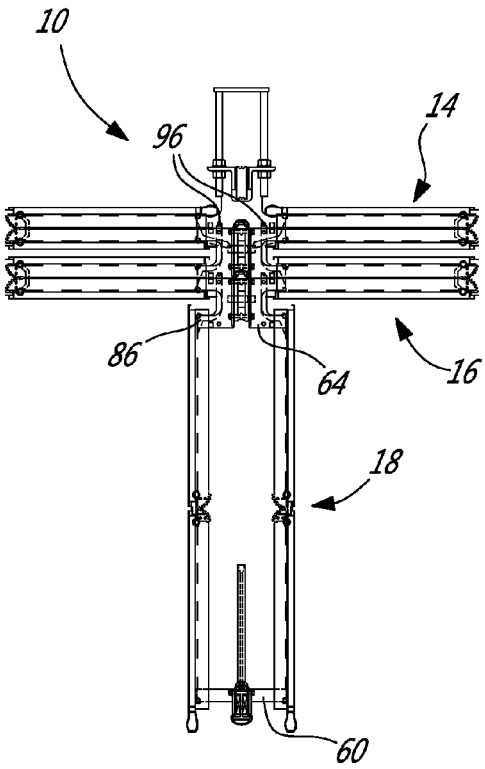
Figure 5E:
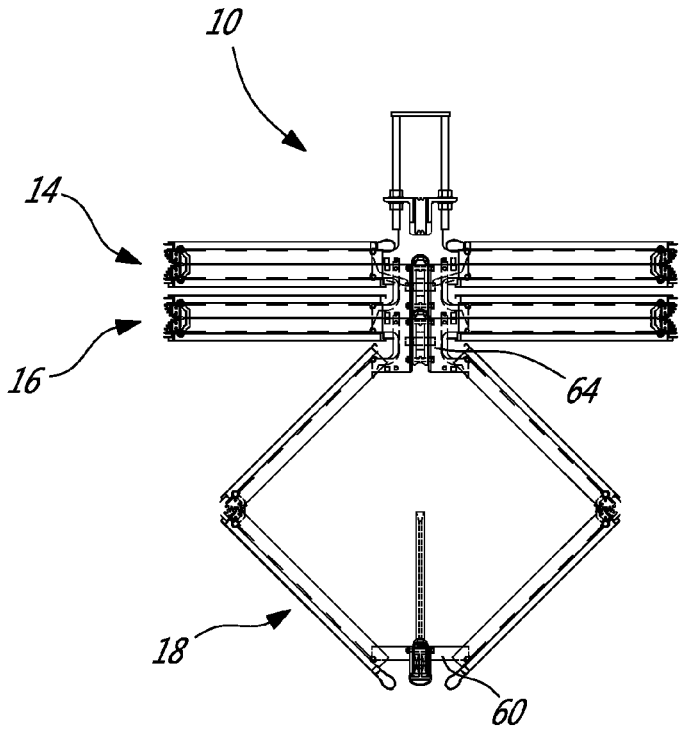
Figure 5F:
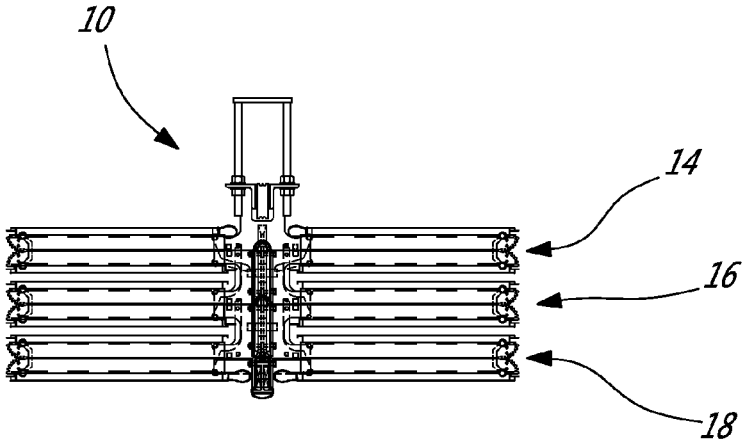

Once the lower support 64 has been displaced up to the upper support 62 so as to completely collapse the intermediate panel assemblies 16 in a surface-to-surface stacked relationship, as shown in FIG. 5D, the pins 96 of the upper support 62 engage the bottom levers 86 of the lower support 64, which assist in the folding motion of the foldable arms 20 of the lowermost panel assemblies 18 and provide for a soft start of their folding motion. The bottom linkage 60 moves upwardly, folding the lowermost panel assemblies 18, as shown in FIGS. 5E-5F.

In embodiments where more than one intermediate panel assembly 16 is provided for each set, the intermediate panel assemblies 16 fold starting with the top one and following a downwardly progressing sequence.

In a particular embodiment, each panel assembly 14, 16, 18 is folded by moving its bottom end toward its top end with the top end remaining at a fixed height corresponding to its height when the wall partition 10 is completely folded, such that each panel assembly 14, 16, 18 is folded at the maximum height possible.

The panel assemblies 14, 16, 18 are unfolded in the inverse sequence. Thus, the lowermost panel assemblies 18 are first deployed followed by the intermediate panel assemblies 16 and finally the uppermost panel assemblies 14. Such a sequential folding may contribute to render the operation of the wall partition 10 safer, in that the lowermost panel assemblies 18 are the last to fold and first to unfold and as such do so at a height which is normally above object or persons standing next thereto. The pinch points between the adjacent panels 26, 28 as the panel assemblies 14, 16, 18 are folded and unfolded are also created relatively high and usually above room occupants. The panel assemblies 14, 16, 18 being folded and unfolded relatively high may also facilitate the fitting of the wall partition 10 between furniture since less clearance may be required along the bottom of the wall partition 10.

The cable and pulley assembly(ies) 102 also slow(s) the vertical motion of the wall partition 10 as it is being deployed and speed(s) up the vertical motion of the wall partition 10 as it is being folded, i.e. the speed of deployment of the wall partition 10 is progressively reduced as the wall partition 10 descends and the speed of retraction of the wall partition 10 is progressively increased as the wall partition 10 is lifted, without changing the parameters of the motor 100. The slower movement of the wall partition at a low height may provide for a safer deployment, particularly in the proximity of the room occupants.

The above description is meant to be exemplary only, and one skilled in the art will recognize that changes may be made to the embodiments described without departing from the scope of the invention disclosed. Modifications which fall within the scope of the present invention will be apparent to those skilled in the art, in light of a review of this disclosure, and such modifications are intended to fall within the appended claims.

The invention claimed is:

1. A vertically folding wall partition comprising:

a set of foldable panel assemblies serially and pivotally connected through a series of vertically spaced apart supports, an uppermost of the panel assemblies having a top end pivotally connected to a hanger for engagement to an overhead structure and a lowermost of the panel assemblies having a bottom end pivotally connected to a bottom linkage, each panel assembly including an upper panel and a lower panel pivotally connected to one another, the upper and lower panels extending substantially in a common vertical plane when in a deployed position and extending laterally outwardly of said common vertical plane in an opposed surface-to-surface stacked relationship when in a folded position; and a moving mechanism engaging each support and the bottom linkage to sequentially move the panel assemblies between the folded and deployed positions, the moving mechanism varying a distance between opposed ends of each panel assembly following a downwardly progressing sequence starting with the uppermost panel assembly as the panel assemblies are moved from the deployed position to the folded position, and the moving mechanism varying the distance between the opposed ends of each panel assembly following an upwardly progressing sequence starting with the lowermost of the panel assemblies as the panel assemblies are moved from the folded position to the deployed position;

wherein the moving mechanism includes a support pulley retained on each support and a plurality of hanger pulleys retained on the hanger, each pulley being rotatable about a respective horizontal axis; a cable having a first end connected to the bottom linkage and extending directly to engagement with one of the hanger pulleys, following which the cable extends in engagement with each support pulley in alternation with a corresponding one of the hanger pulley, the support pulleys being engaged following an upwardly progressing sequence starting at a lowermost of the support pulleys; and a motor operatively connected to a second end of the cable to selectively apply tension thereto and release tension therefrom.

2. The wall partition as defined in claim 1, wherein the set of panel assemblies has a first set of panel assemblies and a second set of panel assemblies, being symmetrically disposed relative to a central plane of the wall partition and being connected by the supports, the upper and lower panels of the first and second sets extending laterally outwardly away from each other in the deployed position, the two sets defining a double sided-wall partition.

3. The wall partition as defined in claim 1, wherein the panel assemblies include foldable arms serially interconnected by the supports, each foldable arm including an upper arm segment and a lower arm segment pivotally connected to one another and respectively supporting the upper panel and the lower panel of a corresponding one of the panel assemblies.

4. The wall partition as defined in claim 1, wherein the set of foldable panel assemblies includes the uppermost panel assembly, the lowermost panel assembly, and a single intermediate panel assembly.

5. The wall partition as defined in claim 1, wherein the set of foldable panel assemblies includes the uppermost panel assembly, the lowermost panel assembly, and a single intermediate panel assembly, the supports including an upper support interconnecting the uppermost and intermediate panel assemblies and a lower support interconnecting the intermediate and lowermost panel assemblies, the cable extending from the bottom linkage to, in order, a first one of the hanger pulleys, the support pulley of the lower support, a second one of the hanger pulleys, the support pulley of the upper support, and a third one of the hanger pulleys.

6. The wall partition as defined in claim 5, wherein the cable further extends from the third one of the hanger pulleys to, in order, the support pulley of the upper support and the third one of the hanger pulleys before being connected to the motor.

7. The wall partition as defined in claim 1, wherein each panel assembly includes a kicking mechanism including an angled lever pivotally connected thereto intermediate two ends of the lever, each lever being pivotable to an engaged position in contact with and pushing outwardly against the panels of a respective one of the panel assemblies to start a motion thereof from the deployed position to the folded position.

8. The wall partition as defined in claim 7, wherein the set of foldable panel assemblies includes the uppermost panel assembly, the lowermost panel assembly, and a single intermediate panel assembly, the supports including an upper support interconnecting the uppermost and intermediate panel assemblies and a lower support interconnecting the intermediate and lowermost panel assemblies, the upper support including a first trigger element moving the lever of the kicking mechanism of the uppermost panel assembly to the engaged position thereof, the hanger including a second trigger element moving the lever of the kicking mechanism of the intermediate panel assembly to the engaged position thereof when the upper support is adjacent the hanger, and the upper support including a third trigger element moving the lever of the kicking mechanism of the lowermost panel assembly to the engaged position thereof when the lower support is adjacent the upper support.

9. A vertically folding wall partition comprising:

first and second sets of foldable panel assemblies interconnected by a series of vertically spaced apart supports to define a double wall partition, the panel assemblies of each set being serially and pivotally connected through the supports, each panel assembly including an upper panel and a lower panel pivotally connected to one another, the upper and lower panels of a same one of the sets extending substantially in a common vertical plane when in a deployed position and extending laterally outwardly of said common vertical plane in an opposed surface-to-surface stacked relationship when in a folded position, the panel assemblies of the first and second sets extending laterally outwardly away from each other in the folded position;

a hanger pivotally connected to a top end of an uppermost of the panel assemblies of each set for engagement to an overhead structure;

a bottom linkage pivotally connected to a bottom end of a lowermost of the panel assemblies of each set;

a support pulley retained on each support and a plurality of hanger pulleys retained on the hanger, each pulley being rotatable about a respective horizontal axis;

a cable having a first end connected to the bottom linkage and extending directly to engagement with one of the hanger pulleys, following which the cable extends in engagement with each support pulley in alternation with a corresponding one of the hanger pulleys, the hanger pulleys, the support pulleys being engaged following an upwardly progressing sequence starting at a lowermost of the support pulleys; and a motor operatively connected to a second end of the cable to selectively apply tension thereto and release tension therefrom.

10. The wall partition as defined in claim 9, wherein the panel assemblies include foldable arms serially interconnected by the supports, each foldable arm including an upper arm segment and a lower arm segment pivotally connected to one another and respectively supporting the upper panel and the lower panel of a corresponding one of the panel assemblies.

11. The wall partition as defined in claim 9, wherein each set of foldable panel assemblies includes the uppermost panel assembly, the lowermost panel assembly, and a single intermediate panel assembly.

12. The wall partition as defined in claim 11, wherein the supports include an upper support interconnecting the uppermost and intermediate panel assemblies and a lower support interconnecting the intermediate and lowermost panel assemblies, the cable extending from the bottom linkage to, in order, a first one of the hanger pulleys, the support pulley of the lower support, a second one of the hanger pulleys, the support pulley of the upper support, and a third one of the hanger pulleys.

13. The wall partition as defined in claim 12, wherein the cable further extends from the third one of the hanger pulleys to, in order, the support pulley of the upper support and the third one of the hanger pulleys before being connected to the motor.

14. The wall partition as defined in claim 9, wherein each panel assembly includes a kicking mechanism including an angled lever pivotally connected thereto intermediate two ends of the lever, each lever being pivotable to an engaged position in contact with and pushing outwardly against the panels of a respective one of the panel assemblies to start a motion thereof from the deployed position to the folded position.

15. The wall partition as defined in claim 14, wherein each set of foldable panel assemblies includes the uppermost panel assembly, the lowermost panel assembly, and a single intermediate panel assembly, the supports including an upper support interconnecting the uppermost and intermediate panel assemblies and a lower support interconnecting the intermediate and lowermost panel assemblies, the upper support including a first trigger element moving the lever of the kicking mechanism of the uppermost panel assembly to the engaged position thereof, the hanger including a second trigger element moving the lever of the kicking mechanism of the intermediate panel assembly to the engaged position thereof when the upper support is adjacent the hanger, and the upper support including a third trigger element moving the lever of the kicking mechanism of the lowermost panel assembly to the engaged position thereof when the lower support is adjacent the upper support.

16. A method of lifting the wall partition of claim 1 including the series of pivotally connected vertically foldable panel assemblies from the deployed position where two pivotally connected panels thereof extend substantially in said common vertical plane, the method comprising:

lifting the lowermost of panel assemblies in the deployed position by sequentially moving each remaining panel assembly from the deployed position to the folded position where the panels thereof extend laterally outwardly of said common vertical plane in said opposed surface-to-surface stacked relationship, the remaining panel assemblies being moved to the folded position following said downwardly progressing sequence starting with the uppermost of the panel assemblies; and moving the lowermost panel assembly to the folded position where the panels thereof extend laterally outwardly of said common vertical plane in said opposed surface-to-surface stacked relationship.

17. The method as defined in claim 16, wherein a vertical speed of the lowermost panel assembly increases progressively as the lowermost panel assembly is lifted.

18. The method as defined in claim 16, wherein sequentially moving each remaining panel assembly from the deployed position to the folded position includes starting a motion of each remaining panel assembly from the deployed position by pushing each remaining panel assembly toward the folded position with the corresponding lever.

* * * * *